United States Patent [19]

Bradley

[11] Patent Number: 4,691,908

[45] Date of Patent: Sep. 8, 1987

[54] APPARATUS FOR INTERFOLDING

[75] Inventor: John J. Bradley, Green Bay, Wis.

[73] Assignee: Paper Converting Machine Company, Green Bay, Wis.

[21] Appl. No.: 816,441

[22] Filed: Jan. 6, 1986

[51] Int. Cl.[4] ..... B41F 13/56

[52] U.S. Cl. ..... 270/21.1; 493/360; 493/361; 493/433

[58] Field of Search ..... 270/21.1, 39, 40; 83/100; 493/340, 353, 359, 360, 361, 362, 370, 410, 416, 418, 430, 433

[56] References Cited

U.S. PATENT DOCUMENTS

| | | | |
|---|---|---|---|
| 2,165,786 | 7/1939 | Christman | 493/418 X |
| 2,631,845 | 3/1953 | Zuckerman | 270/21.1 |
| 3,044,766 | 7/1962 | Banks | 493/433 |
| 3,540,723 | 11/1970 | Schuenemann et al. | 493/360 |
| 4,052,048 | 10/1977 | Shirasaka | 270/40 |
| 4,279,411 | 7/1981 | Nystrand | 270/39 |
| 4,494,741 | 1/1985 | Fischer et al. | 270/39 |
| 4,530,687 | 7/1985 | Keeny et al. | 493/361 |

*Primary Examiner*—E. H. Eickholt

*Attorney, Agent, or Firm*—Tilton, Fallon Lungmus & Chestnut

[57] ABSTRACT

Apparatus for interfolding webs, including two clusters of vacuum rolls, each in a generally hexagonal arrangement, each cluster having spaced apart web cutoff means and interfolding means, the vacuum rolls being arranged to develop four equal length paths between the cutoff means and the interfolding means, the apparatus being equipped with vacuum switching means to sequentially change paths of travel of the webs.

10 Claims, 15 Drawing Figures

APPARATUS FOR INTERFOLDING

This invention relates to an apparatus for interfolding and, more particularly, to an apparatus that is adapted to develop alternate stacks of interfolded webs, whereby continuous, automatic operation is achieved.

BACKGROUND AND SUMMARY OF INVENTION

The invention makes use of vacuum rolls for transferring the web from one position to another—vacuum rolls in folding having been long used—see co-owned U.S. Pat. No. 2,165,786. Further, the concept of having two webs with the transverse lines of perforation offset, so as to develop an interfolded product, is also well known, see U.S. Pat. No. 3,044,766. More recently, it has been desired to operate at higher speeds and the removal of the interfolded stacked product has constituted a speed limitation. This is particularly true with "short counts", viz., relatively small stacks. Therefore, it was desirable to provide alternate interfolders so that when the stack was being removed from one interfolder, the other could be developing a subsequent stack. Representative of this is U.S. Pat. No. 4,494,741.

A number of disadvantages characterized the '741 Patent construction. There, two webs were combined immediately after perforation and then had to be separated at transition from one interfolding position to the other. Further, the '741 Patent required a precise balance between perforation bond strength, web porosity and the vacuum source. Too much vacuum effect and the outer of the superposed webs did not stay on its roll, whereas too little would not result in a breaking of the bonds.

According to the instant invention, the combination of the two webs is delayed until the last operation before interfolding. By this means, the transition from one interfolding position to the other requires only redirecting the paths of the two webs as individual webs. An advantageous aspect of the invention is the provision of two pluralities of vacuum rolls defining four equal length paths between cut-off devices and interfolders. To effectuate the switch from one interfolding position to another, I employ vacuum rolls that are selectively vacuumized, depending upon the path to be chosen.

The invention is described in conjunction with an illustrative embodiment in accompanying drawing, in which FIG. 1 is a schematic elevational view showing the roll arrangement with interfolding being achieved in the left lower position;

DETAILED DESCRIPTION

Figure 1:
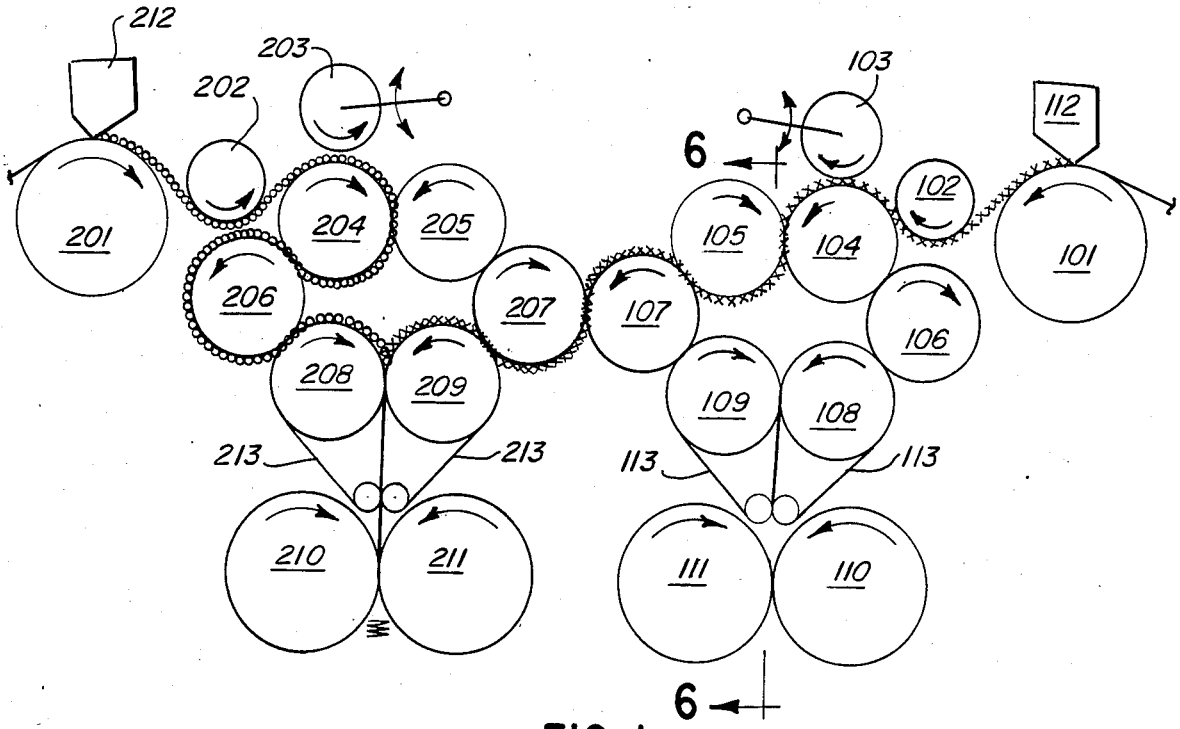

In FIG. 1, the right-hand web (designated by crosses) travels from right to left over a perforating roll 101. The perforating roll contains flexible blades which operate against a stationary anvil 112 to perforate the web transversely at regular intervals. The perforated web continues around a guide-transfer roll 102 to a cutoff roll 104. The web continues on around rolls 105, 107, 207 and 209, where it joins the left-hand web (designated by circles). The left-hand web (circles) travels from left to right over a perforating roll 201. The perforating roll contains flexible blades which operate against a stationary anvil 212 to perforate the web transversely at regular intervals. The perforated web continues around guide-transfer roll 202 to cutoff roll 204. The web continues on around rolls 206 and 208 to the nip between 208 and 209 where it joins the right-hand web (crosses).

The two webs are then carried via stripper belts 113 to zig-zag folding rolls 210 and 211, which create the interfolded product.

Figure 2:
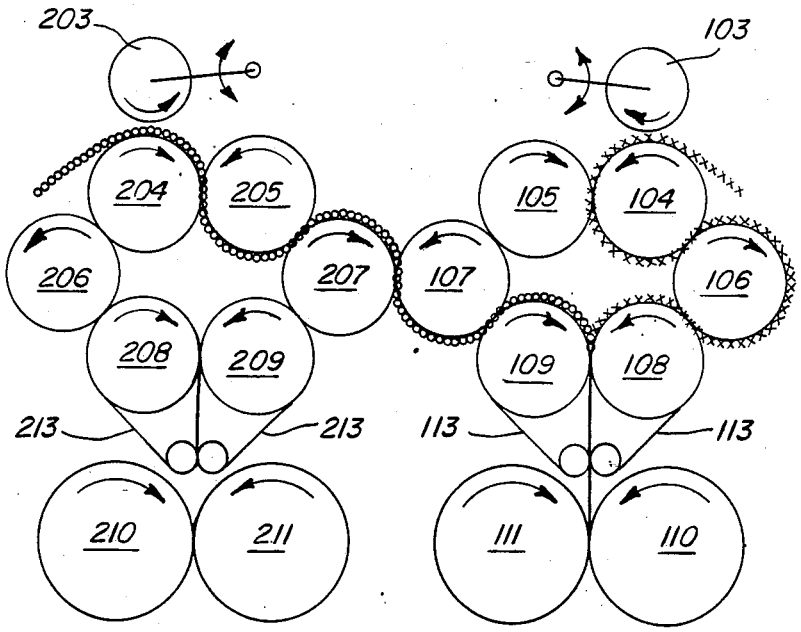
FIG. 2 is a view similar to FIG. 1, but showing the alternate operation, wherein the stack is being developed in the lower right-hand position.

Transition from FIG. 1 to FIG. 2 Operation

When the correct number of perforated sheets have passed over rolls 104 and 204 to make a complete stack (typically 51 or 101 sheets), cutoff rolls 103 and 203, which carry transverse, radial knives, pivot into a position where the knives in rolls 103 and 203 enter corresponding slots in rolls 104 and 204 to break the perforations and sever both webs at the correct sheet count. Vacuum in rolls 104 and 204 holds the leading edge of the webs in place on these rolls. It is to be noted that perforations are optional—that the cutoff devices will sever unperforated webs.

Following the right-hand web, the leading edge is carried by vacuum in roll 104 to the nip between rolls 104 and 106 where vacuum in roll 106 takes the leading edge from roll 104 and carries it to the nip between rolls 106 and 108. Vacuum in roll 108 takes the leading edge from 106 and carries it to the nip between rolls 108 and 109, where it joins the left-hand web (circles).

Following the left-hand web, the leading edge is carried by vacuum in roll 204 to the nip between rolls 204 and 205, where vacuum in roll 205 takes the leading edge from roll 204 and carries it to the nip between rolls 205 and 207. Vacuum in roll 207 takes the leading edge from roll 205 and carries it to the nip between rolls 207 and 107. Vacuum in roll 107 takes the leading edge from roll 207 and carries it to the nip between rolls 107 and 109. Vacuum in roll 109 takes the leading edge from roll 107 and carries it to the nip between rolls 108 and 109, where it joins the right-hand web.

The two webs are then carried via stripper belts 113 to zig-zag folding rolls 110 and 111, which create the interfolded product.

When the correct number of perforated sheets have passed over rolls 104 and 204 to make a complete stack, the previously described transition is reversed to return to folding rolls 210 and 211.

While folding rolls 210 and 211 (or 110 and 111) are building a stack of folded product, the finished product from rolls 110 and 111 (or 210 and 211) is removed to prepare for building the next stack.

By using vacuum continuously, this machine can handle webs that are cut sheets which are not connected by bonds as a perforated web. Through the use of the invention, it is possible to handle short count stacks by maximizing the time available for removing finished stacks and also to avoid the difficult problem of separating individual stacks after the webs have been interfolded.

The four equal length web paths between the cutoff means and interfolding means are defined as follows:

A. From the nip between rolls 204, 205 to the nip between rolls 208, 209 via roll 206;

B. From the nip at rolls 204, 205 to the nip at rolls 108, 109 via rolls 207 and 107;

C. From the nip at rolls at 104, 105 to the nip at rolls 108, 109 via roll 106; and D. From the nip at rolls 104, 105 to the nip at rolls 208, 209 via rolls 107 and 207.

Sheet Count

When the folding rolls 210 and 211 start to interfold a product as shown in FIG. 1, the first panel is provided by the left-hand web (circles).

When the programmed sheet counts for the finished stack have been produced, the right-hand web (crosses) is cutoff first, and the left-hand web (circles) is cutoff second. The sequence of cutoff is necessary when changing from the FIG. 1 operation to the FIG. 2 operation, in order to avoid a critical interference at the nip between rolls 207 and 107. If the left-hand web (circles) is cutoff first and the right-hand (crosses) second, the leading half of the first left-hand (circles) sheet will overlap the trailing panel of the last right-hand (crosses) sheet at the nip between rolls 207 and 107. This overlap will prevent the intended transfer of the left-hand web (circles) from roll 207 to roll 107. This required transition sequence means that the last panel in the finished stack produced by folding rolls 210 and 211 is also from the left-hand web (circles).

When folding rolls 110 and 111 (see FIG. 2) start to interfold the product, the first panel is from the right-hand web (crosses).

When the programmed sheet counts for the finished stack have been produced, the left-hand web (circles) is cutoff first and the right-hand web (crosses) is cutoff second. This sequence of cutoff is necessary when changing from the FIG. 2 operation to the FIG. 1 operation, in order to avoid the previously mentioned critical interference at the nip between the rolls 207 and 107. The necessary transition sequences means that each finished stack will contain an odd (not even) number of sheets. This use of extra material (1–2%) is acceptable in light of the high efficiency of production and the avoidance of large fixed costs in space and equipment. Conventionally, a high speed 100 count product required 100 parent rolls disposed along a conveyor path with folding boards—see, for example, U.S. Pat. No. 4,052,048.

Vacuum System

The apparatus employs a combination of conventional rotary vacuum valves on the ends of the rolls, and electrically operated vacuum/atmosphere control values in the vacuum piping to the rotary valves.

Four rolls, 101, 102, 201 and 202, use only conventional rotary vacuum valves, which are always connected to a vacuum source. These rolls always have the same vacuum requirements, regardless of the mode of operation, viz., whether in the FIG. 1 or the FIG. 2 mode.

Figure 3:
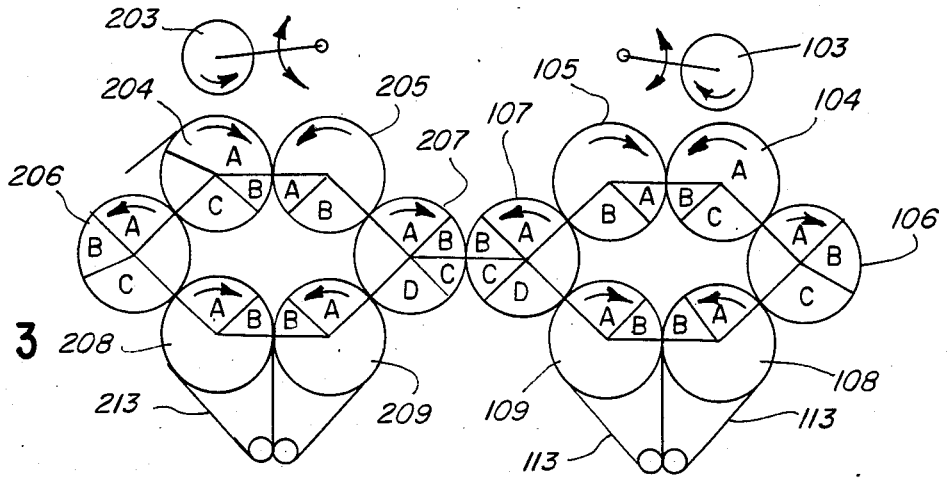
FIG. 3 is a view similar to FIGS. 1 and 2, but further showing how the various vacuum rolls are chambered to provide vacuum sectors.

Two sections or sectors of two rolls (A of 104 and A of 204)—see FIG. 3—use only conventional rotary vacuum valves, which are always connected to a vacuum source. These sections of these rolls always have the same vacuum requirements, regardless of the mode of operation. All remaining rolls and sections use conventional rotary vacuum valves and electrically operated vacuum/atmosphere control valves, because their vacuum requirements change according to the mode of operation.

Figure 4:
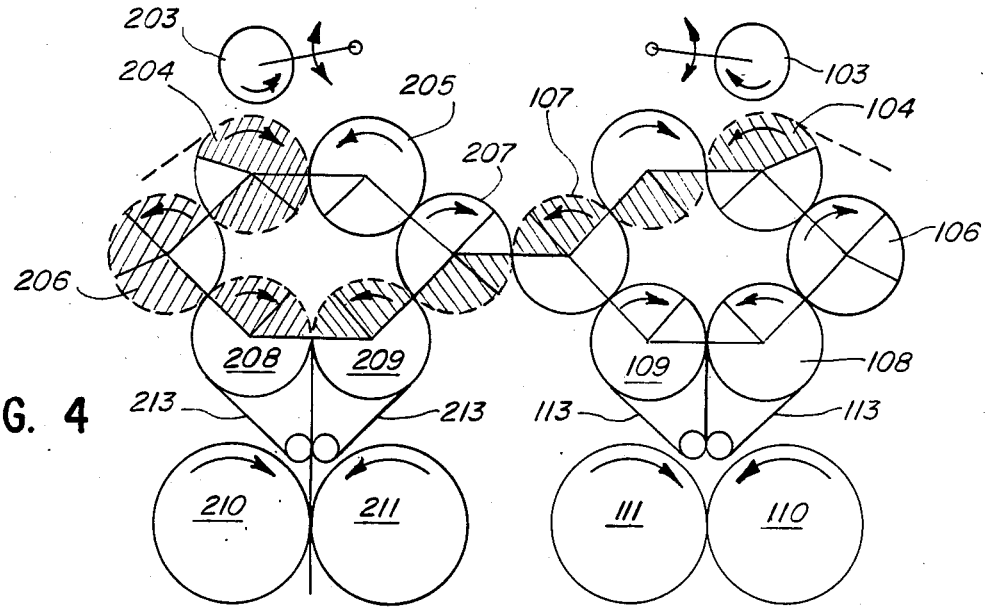
FIG. 4 is a view similar to FIG. 3 and showing the activation of certain of the sectors for the development of a stack in the lower left-hand corner, viz., the operation depicted in FIG. 1.
Figure 5:
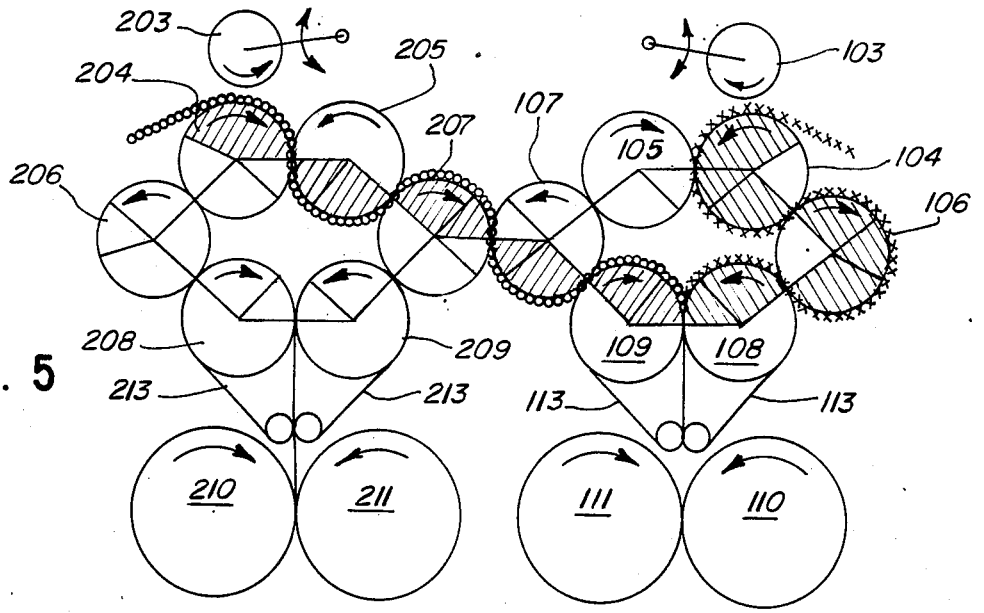
FIG. 5 is a view similar to FIG. 4, but showing the vacuumized sectors in the various vacuum rolls for the operation previously depicted in FIG. 2.
Figure 9:
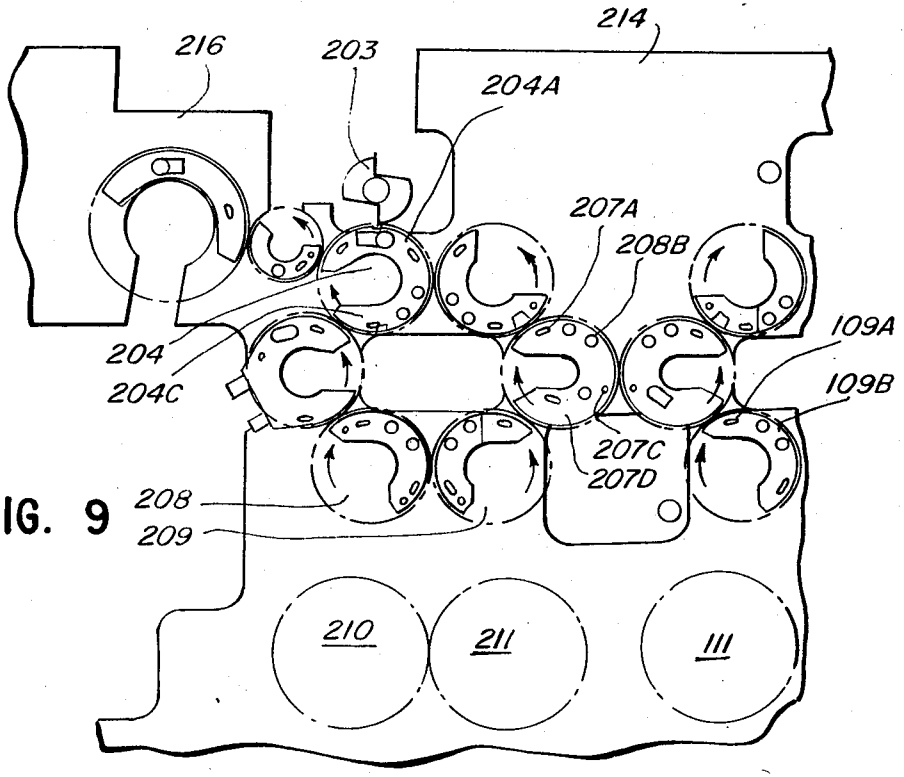
FIG. 9 is a fragmentary side elevational view of the rotary vacuum valve provided on the ends of the vacuum rolls—just interiorally of the side frame seen in FIG. 6.

Taking roll 204 as an example, it will be seen that both sections B and C of 204 (comparing FIGS. 3 and 4), are vacuumized when operating in the FIG. 4 (also FIG. 1) mode. When switching to the FIG. 5 (also FIG. 2) mode, wherein the left-hand web (circles) only travels over the upper half of roll 204, the sections B and C of roll 204 are deactivated. The mirror image roll 104 has just the opposite operation. In FIG. 4 (corresponding to FIG. 1), sections B and C of 104 are not vacuumized whereas in FIG. 5 (corresponding to FIG. 2), sections B and C of 104 are vacuumized.

In the illustration given, each plurality or cluster of rolls that are equipped with electrically operated valves include six rolls, viz., rolls 204–209 and 104–109. These rolls are arranged in generally hexagonal fashion, as can be appreciated from the lines defining the vacuum sections in FIGS. 3–5. In the FIG. 4 (also FIG. 1) mode of operation, rolls 205 and 106, 108 and 109 are inactive. By the same token, in the FIG. 5 (also FIG. 2) mode of operation, their counterparts or mirror images—105 and 206, 208 and 209—are inactive. Of the rolls equipped with the electrically operated valves, only rolls 207 and 107 are activated in both modes, but in different sections or sectors thereof (compare FIGS. 4 and 5).

When changing from one mode of operation to the other, vacuum is sequentially turned off in those rolls and sections which will not require vacuum in the next mode of operation. Vacuum must be retained until the last sheet is passed, then it is turned off.

At the same time, vacuum is sequentially turned on in those rolls and sections which will require vacuum in the next mode of operation. Vacuum must be active when the first sheet arrives at each section of each roll.

Figure 6:
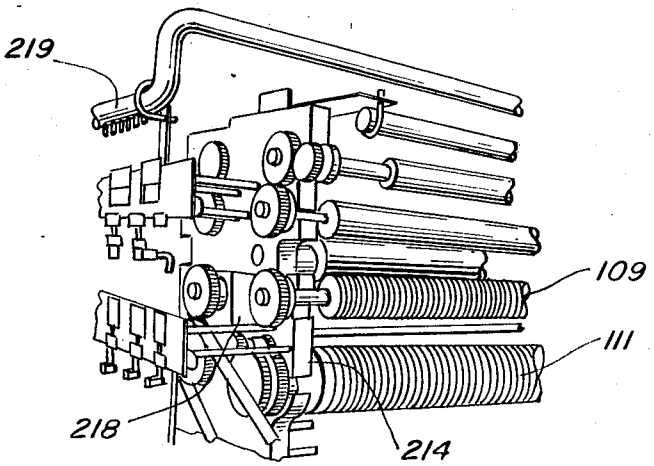
FIG. 6 is a fragmentary perspective view, such as would be seen along the sight line 6—6 of FIG. 1.
Figure 7:
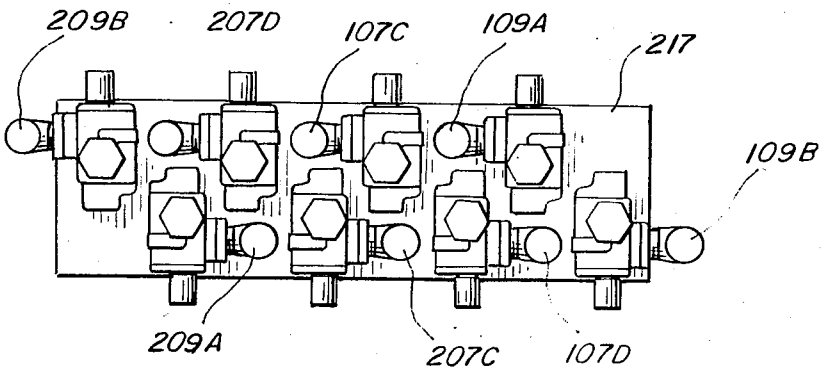
FIG. 7 is a sight elevational view of the solenoid valves seen in the lower left-hand portion of FIG. 6.

The valving, which makes possible the change of application of vacuum to different roll sectors to sequentially remove vacuum from rolls in one path between the first cutoff means (rolls 203–204) and the second folding means (rolls 108–111), and from rolls in a path between the second cutoff means (rolls 103–104) and the second folding means (rolls 108–111) is seen on the third drawing sheet including FIGS. 6–9. At the same time that the valving system is sequentially removing the vacuum from certain sectors of rolls in the two paths just described, the system is sequentially applying vacuum to sectors of rolls in the other two paths, viz., the paths between the first and second cutoff means 203–204 and 103–104, respectively, and second interfolding means (rolls 208–211). In FIG. 6, the rolls 109 and 111 can be seen in the lower right-hand portion—being rotatably supported in a frame 214, one side of which is depicted in FIG. 6. In the illustrated embodiment, the apparatus is made up in three sections which can be split or moved longitudinally relative to each other for maintenance, roll replacement, etc. For example, in referring to FIG. 15, the frame is split along the sight line 6—6 and also is split along the sight line 6A—6A. Thus, there is the frame section 214, previously identified in FIG. 6, and sections 215 and 216, which, for all practical purposes, are mirror images of each other. This is particularly true when the two unwinds (not shown) are on opposite ends of the machine, viz., to the right and left in FIG. 15. It will be appreciated, however, that both unwinds could be located both either to the right or to the left.

Returning now to FIG. 6, it will be seen that there are a plurality of solenoid values in the left-hand portion of this view. These are shown in side and end elevation, respectively, in FIGS. 7 and 8, and are designated by numerals which correspond to the sector designations previously described in conjunction with FIG. 3. It will be appreciated that each sector has its own solenoid valve, these being supported on a plate 217 by pipe beams 218. Omitted from FIG. 6 for ease of understanding are the individual pipes connecting the various solenoid valves with the vacuum manifold 219, shown in the upper left-hand corner.

Also omitted for ease of understanding is the piping from the various solenoids to the vacuum valves, which are positioned on the inside of the frames 214–216. These vacuum valves are segmentally arcuate to cover sectors of the vacuum rolls and can be seen FIG. 9. There, certain of the vacuum valves are designated in fashion corresponding to that of FIG. 3.

Figure 8:
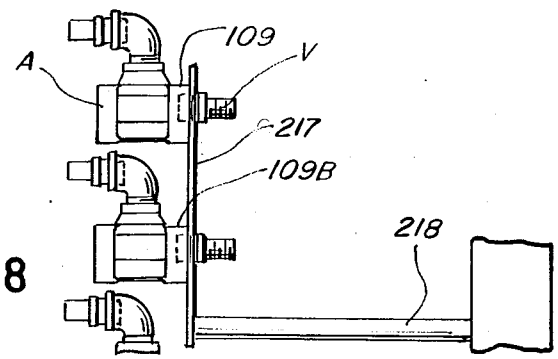
FIG. 8 is an end elevational view of the solenoid valves seen in FIG. 7.

I have found it advantageous to utilize a programmable controller for sequentially actuating the solenoid valves to deliver either vacuum V or vent to atmosphere as at V and A in the upper right-hand portion of FIG. 8. A suitable controller is a Reliance Corporation Model 30A Automate, which has a rapid response rate of 3.2 milliseconds.

Interfolding Means

Figure 10:
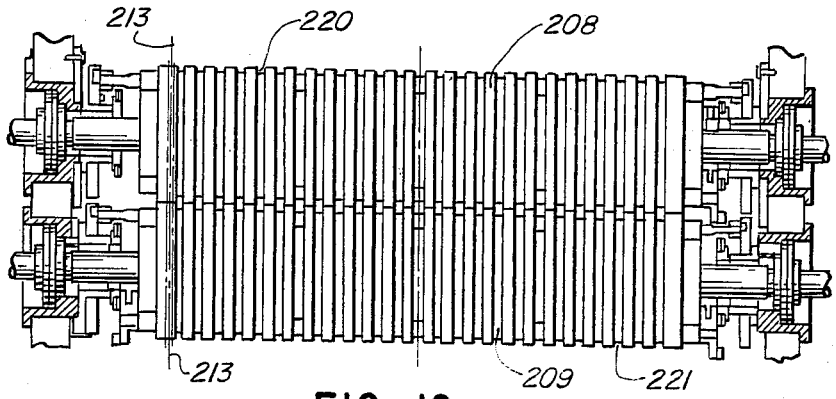
FIG. 10 is a plan view of one pair of bottom vacuum rolls equipped with grooves for stripper belts, one of the rolls being seen in the lower right central portion of FIG. 6.
Figure 11:
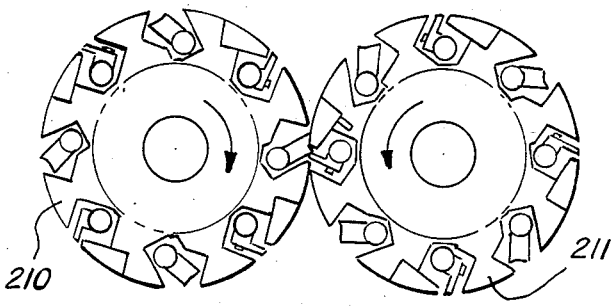
FIG. 11 is an end elevational view of one pair of folding rolls, one of which is seen in the lower right-hand portion of FIG. 6.
Figure 12:
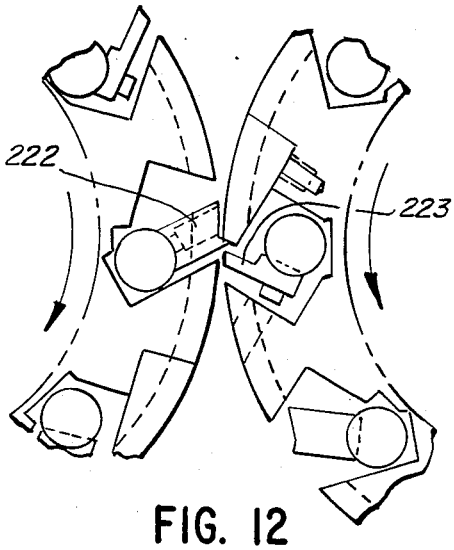
FIG. 12 is an enlarged, fragmentary view of the central portion of FIG. 11.

The interfolding means includes, on the left-hand side, rolls 208–211 with belt system 213 and, on the right-side, rolls 108–111 and belt system 113. Again, for all practical purposes, the two interfolding means are identical except for being mirror images. In FIG. 10, the rolls 208 and 209 are depicted and it will be seen that each is equipped with a plurality of grooves 220 and 221, respectively for entraining the belts of the belt system 213. The belts of the belt systems are entrained toward the folding rolls, which are illustrated in FIG. 11 in the form of rolls 210 and 211. These rolls are equipped with tuckers as at 222 (see FIG. 12) and grippers 223. As illustrated, each roll 210, 211 is equipped with four each of the tuckers 222 and the grippers 223 arranged alternately in conventional fashion.

Figure 13:
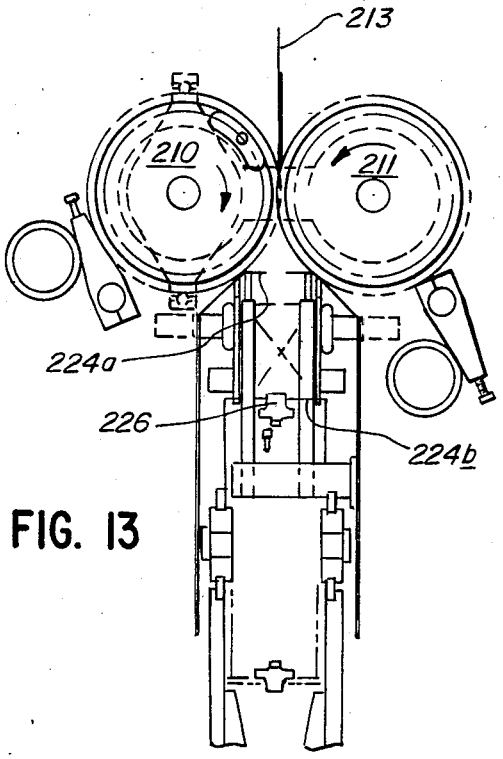
FIG. 13 is an end elevational view of the discharge mechanism portion of the interfolding apparatus showing the folding rolls, an elevator for interfolded stack of web material developed thereby, and a take away conveyor.
Figure 14:
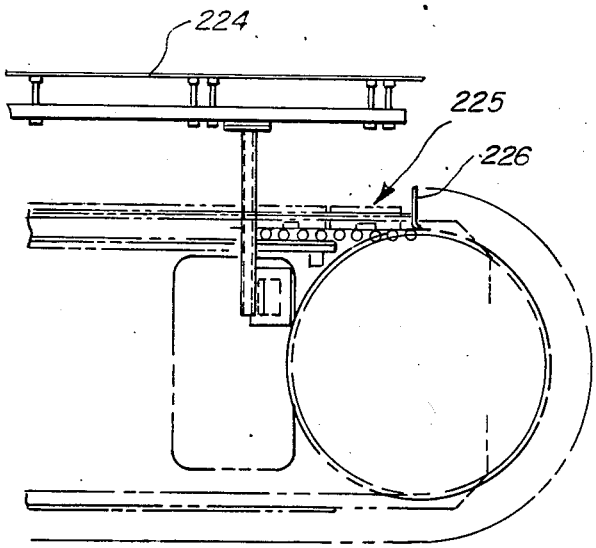
FIG. 14 is a fragmentary end elevational view of the take away conveyor of FIG. 13.

In FIG. 13, the numeral 224 designates generally an elevator, which can be seen in a different elevation in FIG. 14. The elevators (one for each of the interfolding means) descend as stackers are developed by the folding rolls 210, 211 or 110, 111, as the case may be. When a stack is completed and the programmable controller switches the various solenoid valves so as to establish two different paths for the webs, the take way conveyor, generally designated 225, is actuated to move the now completed stack transversely of the machine—as by the pusher 226 (compare FIGS. 13 and 14). For example, in FIG. 13, the upper position of the elevator is designated by the numeral **224*a*, while the most downward position is designated by the numeral 224*b***.

Cutoff and Perforating Means

Figure 15:
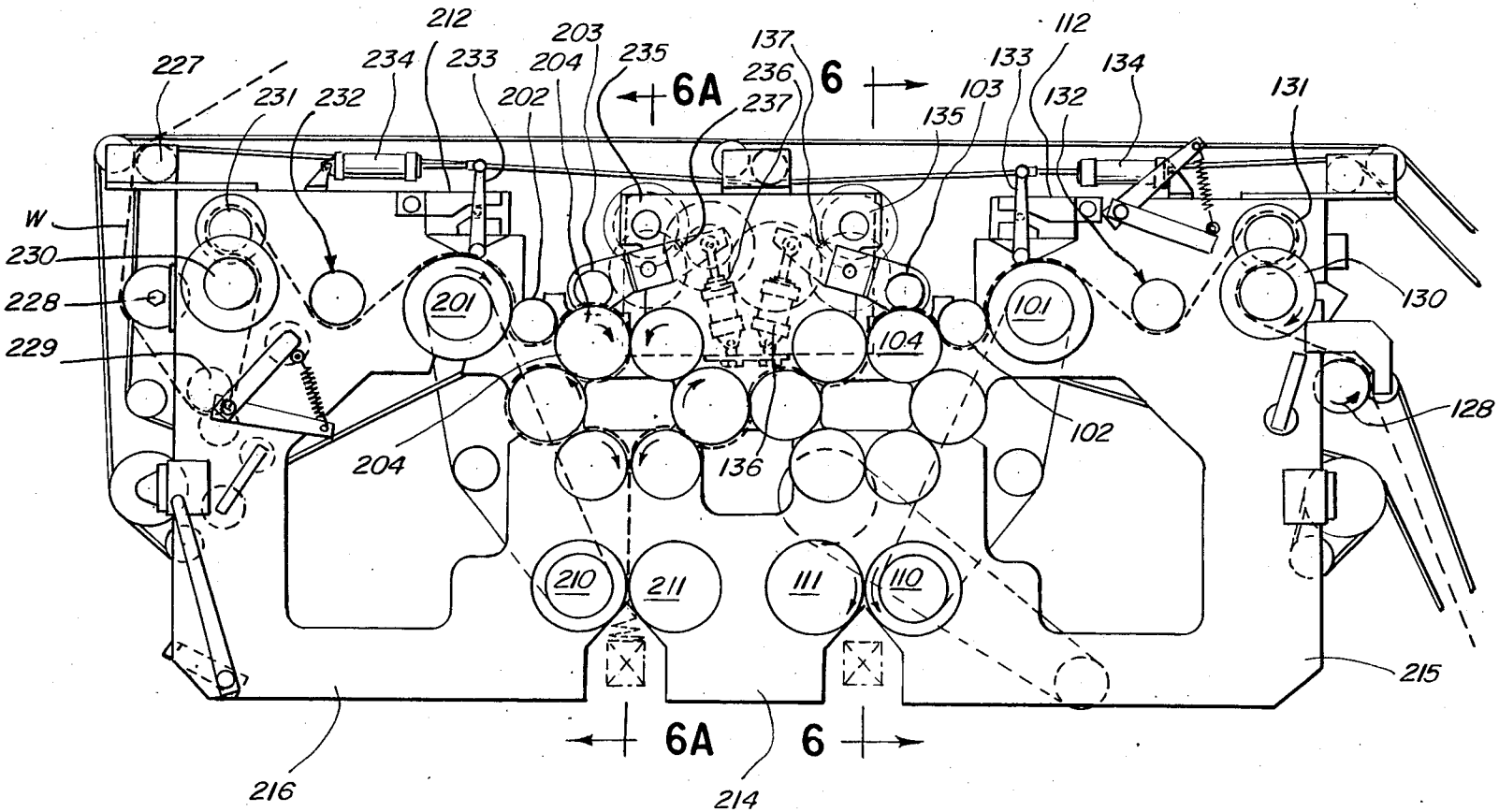
FIG. 15 is a side elevational view of the major components of the inventive interfolder and which features especially the cutoff and perforating mechanisms.

Turning now to the left-hand side of FIG. 15, a web W is derived from an unwind (not shown) and directed around a guide roll 227 and past a spreader roll 228. After passing around another guide roll 229, the web is directed into the nip between pole rolls 230 and 231. Thereafter, the web passes through a strip embosser 232, which is optional, depending upon the character of the product desired. Thereafter, the web passes through the perforator, consisting of the bedroll 201 and the perforating head 212. The head 212 is movably supported on the frame 216 and can be lifted out of perforating engagement with the roll 201 by means of a linkage 233 actuated by an air cylinder 234. A similar arrangement is provided at the right-hand side of the apparatus in FIG. 15, wherein like numerals are employed to designate like parts but being diminished by 100. It will be appreciated that the perforating bedrolls 101 and 201 are out of phase—that one is intermediate a pair of cuts while the other one is cutting. In the illustration given, the bedrolls are 'four time' rolls, viz., with 90° between blades so that the bedrolls are $\frac{1}{8}$th revolution out of phase. This out of phase relationship with the perforators is necessary to have the cuts of one web lie at the midpoint between the cuts on the other web for correct interfolding. However, as indicated previously, perforation is not necessary should the product not require the same, inasmuch as the cutoff employed is independent of the perforations.

Cutoff occurs between the knife roll 203 and the bedroll 204, the web reaching the nip between these two rolls after leaving the perforating bedroll 201 and passing around the guide roll 202.

Cutoff only occurs at the completion of the planned and specified number of sheets, viz., count or web length, as the case may be. When that instant occurs, a cam 235—see the upper central portion of FIG. 15—permits an air cylinder and linkage system 236 to pivot the blade roll 203 into engagement with the slotted roll 204 at a perforation, when a slot is present. The same arrangement is provided on the right-hand side relative to the cylinder and linkage arrangement 136, being actuated by the cam 135 so as to pivot the knife roll 103 into position. The cutting position can be appreciated from a consideration of the upper central portion of FIG. 9, where the knife roll 203 is in cutting engagement with a slot in the bedroll 204.

During most of the operation of the interfolder, both the cutoff rolls are not in cutting engagement. At such time, the associated air cylinder and linkage 136 or 236, as the case may be, holds a cam follower 237 away from the cam 235, keeping knife roll 203 out of engagement with bedroll 204. The same applies to the arrangement on the right-hand side of the apparatus, as seen in FIG. 15. Activation of a cutoff is electrically controlled via the programmable controller (not shown).

Again, the cutoff roll systems will be out of phase with each other, like the perforators. For example, knife roll 103 is 90° out of phase with knife roll 203 (¼th revolution) and bedroll 104 is 60° out of phase with bedroll 204 (1/6th revolution). Bedrolls are three time rolls whereas the knife rolls are two time rolls, hence the difference in phase.

While in the foregoing specification a detailed description of an embodiment of the invention has been set down for the purpose of illustration, many variations in the details herein given may be made by those skilled in the art without departing from the spirit and scope of the invention.

I claim:

1. Apparatus for interfolding webs comprising two pluralities of vacuum rolls, web cutoff means operably associated with each of said roll pluralities, means for feeding a web to each of said cutoff means, an interfolding means operably associated with each of said roll pluralities and spaced from its associated web cutoff means, said vacuum rolls being arranged to develop four equal length single web paths between said cutoff means and said interfolding means, and switching means operably associated with said vacuum rolls for altering the vacuum applied to certain of said rolls to direct web segments to either of said interfolding means.

2. The apparatus of claim 1, in which each of said interfolding means includes a belt system, coupled to a pair of vacuum rolls in its associated plurality for transferring a pair of superposed, offset webs from said pair of vacuum rolls, and a pair of folding rolls coupled to said belt system.

3. The apparatus of claim 1, in which each of said plurality of vacuum rolls includes a contiguous roll in each plurality with said contiguous rolls defining a nip therebetween, said contiguous rolls being equipped with a plurality of vacuum sectors and vacuum control valves for vacuum application irrespective of which interfolding means is being used but having different sectors vacuumized dependant upon which interfolding means is being used.

4. The apparatus of claim 3, in which each plurality includes a cluster of six vacuum rolls arranged generally hexagonally with a top one of said rolls in each cluster functioning as a cutoff roll.

5. The apparatus of claim 4, in which a pair of bottom rolls in each cluster are equipped with grooves for belt stripping of superposed web therefrom.

6. The apparatus of claim 5, in which a pair of folding rolls are positioned below said bottom rolls and elevator means are provided on said frame below said folding rolls.

7. The apparatus of claim 6, in which said frame is equipped with a take away conveyor for each interfolding means elevator and extending transversely of said paths.

8. Apparatus for interfolding, wherein web stacks can be produced alternately so that when one stack is being removed, second stack is being developed, comprising:

a frame, first and second web parent roll means operably associated with said frame for delivering first and second webs to said frame, first and second web cutoff means mounted on said frame, one for each web, first and second web folding means on said frame, spaced from said first and second cutoff means, a plurality of vacuum rolls rotatably mounted on said frame and arranged to define two equal length single web paths from each of said cutoff means to each of said folding means, and control valve means operably associated with said vacuum rolls for changing the application of vacuum to different roll sectors to sequentially remove vacuum from rolls in one path between said first cutoff means and said second folding means and from rolls in one path between said second cutoff means and said second folding means, and to sequentially apply vacuum to rolls in the paths between said first and second cutoff means and said first folding means.

9. The apparatus of claim 8, in which said first and second cutoff means each include an actuatable knife roll cooperating with a bedroll, each journaled on said frame.

10. The apparatus of claim 9, in which perforating means are interposed between each parent roll means and its associated web cutoff means.

* * * * *